US010962342B1

(12) United States Patent
Wilhelm et al.

(10) Patent No.: US 10,962,342 B1
(45) Date of Patent: Mar. 30, 2021

(54) BLAST CONTAINMENT SYSTEM FOR TRASH CANS

(71) Applicant: The United States of America as Represented by the Secretary of the Navy, Indian Head, MD (US)

(72) Inventors: Christopher Wilhelm, Port Tobacco, MD (US); Edward A. Lustig, Jr., Charlotte Hall, MD (US); Eyal Banai, Bethesda, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/873,858

(22) Filed: Jul. 30, 2020

(51) Int. Cl.

| | |
|---|---|
| ***F42D 5/045*** | (2006.01) |
| ***F42B 39/24*** | (2006.01) |
| ***B65F 1/06*** | (2006.01) |

(52) U.S. Cl.
CPC ..... *F42D 5/045* (2013.01); *B65F 1/06* (2013.01); *F42B 39/24* (2013.01); *B65F 2210/13* (2013.01); *B65F 2220/104* (2013.01)

(58) Field of Classification Search
CPC .. B65F 2220/104; B65F 2210/13; F42D 5/04; F42D 5/045; F42D 5/05
See application file for complete search history.

(56) References Cited

U.S. PATENT DOCUMENTS

| | | | | |
|---|---|---|---|---|
| 5,044,173 | A | 9/1991 | Cheng | |
| 7,490,537 | B1 | 2/2009 | Vande Brake | |
| 10,539,404 | B1 * | 1/2020 | Lustig | F42B 39/24 |
| 2012/0305567 | A1 * | 12/2012 | Abbe | B65F 1/1623 220/560.01 |

* cited by examiner

*Primary Examiner* — Joshua T Semick
(74) *Attorney, Agent, or Firm* — Fredric J. Zimmerman

(57) ABSTRACT

A blast containment system for trash cans includes a donut-shaped bag having a sealed donut-shaped bottom positioned at the base of the trash can, and an open donut-shaped top positioned and retained at a top periphery of the trash can. An open-ended tubular region extends through the bag between its donut-shaped top and donut-shaped bottom. A rigid container having an open top is disposed in the tubular region of the bag with its open top being coupled to the donut-shaped top of the bag. A liquid fills the bag. A ballistic fabric is situated inside of the trash can and outside of the donut-shaped bag.

17 Claims, 5 Drawing Sheets

BLAST CONTAINMENT SYSTEM FOR TRASH CANS

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to blast containment systems, and more particularly to a blast containment system for placement in existing trash cans.

BACKGROUND OF THE INVENTION

Current blast-resistant trash receptacles are heavy-duty steel containment vessels that can be used for the purpose of mitigating the effects of pressure and fragmentation from certain types of threats (pipe bomb, backpack, etc.) by helping to mitigate the blast effects of a detonation via containment. However, in their current form, these receptacles can weigh thousands of pounds, cost thousands of dollars each, and provide no capability for use with flash x-ray or many detonation-prevention procedures while the threat is inside the receptacle. These drawbacks limit the practicality and use of current blast-resistant trash receptacles at special events and/or transportation hubs.

SUMMARY OF THE INVENTION

Accordingly, it is an object of the present invention to provide a blast containment system adaptable for use with a variety of existing trash cans.

Another object of the present invention is to provide a blast containment system that may be readily transported to and readily deployed in existing trash cans at special events and/or transportation hubs.

Still another object of the present invention is to provide a cost-effective blast containment system that may be deployed in existing trash cans.

Other objects and advantages of the present invention will become more obvious hereinafter in the specification and drawings.

In accordance with the present invention, a blast containment system for trash cans includes a flexible donut-shaped bag adapted for positioning in a rigid trash can. The bag includes a sealed donut-shaped bottom adapted to be positioned at a base of the trash can, and an open donut-shaped top adapted to be positioned and retained at a top periphery of the trash can. An open-ended tubular region extends through the bag between its donut-shaped top and donut-shaped bottom. The bag is impervious to liquid. A rigid container having an open top is disposed in the tubular region of the bag. The container's open top is coupled to the donut-shaped top of the bag. The container's open top is adapted to be approximately aligned with the top periphery of the trash can. The container has side walls which include ballistic materials. A liquid fills the bag.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
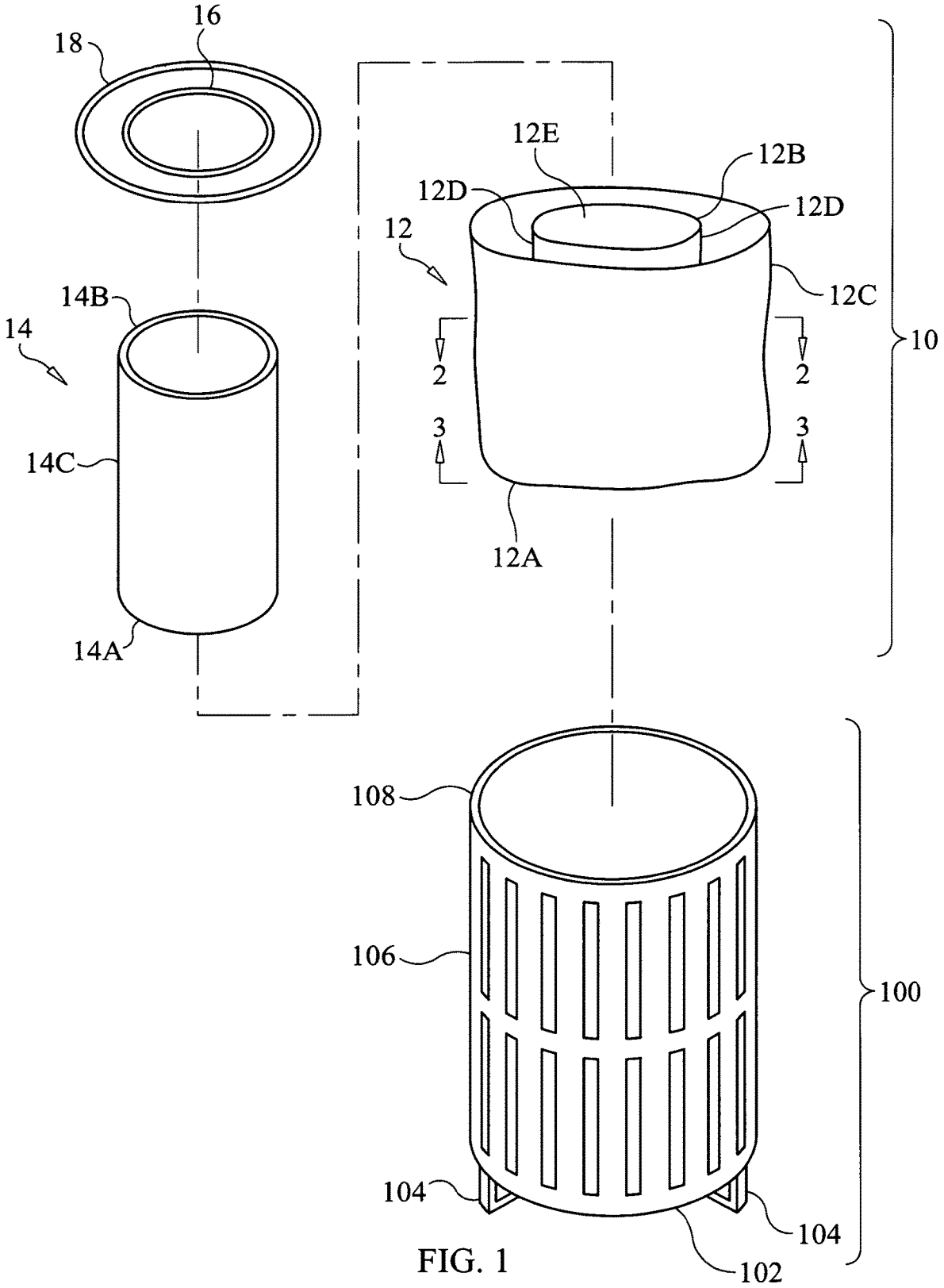
FIG. 1 is an exploded perspective view of portions of a blast containment system for a trash can prior to the filling thereof with a liquid in accordance with an embodiment of the present invention.
Figure 4:
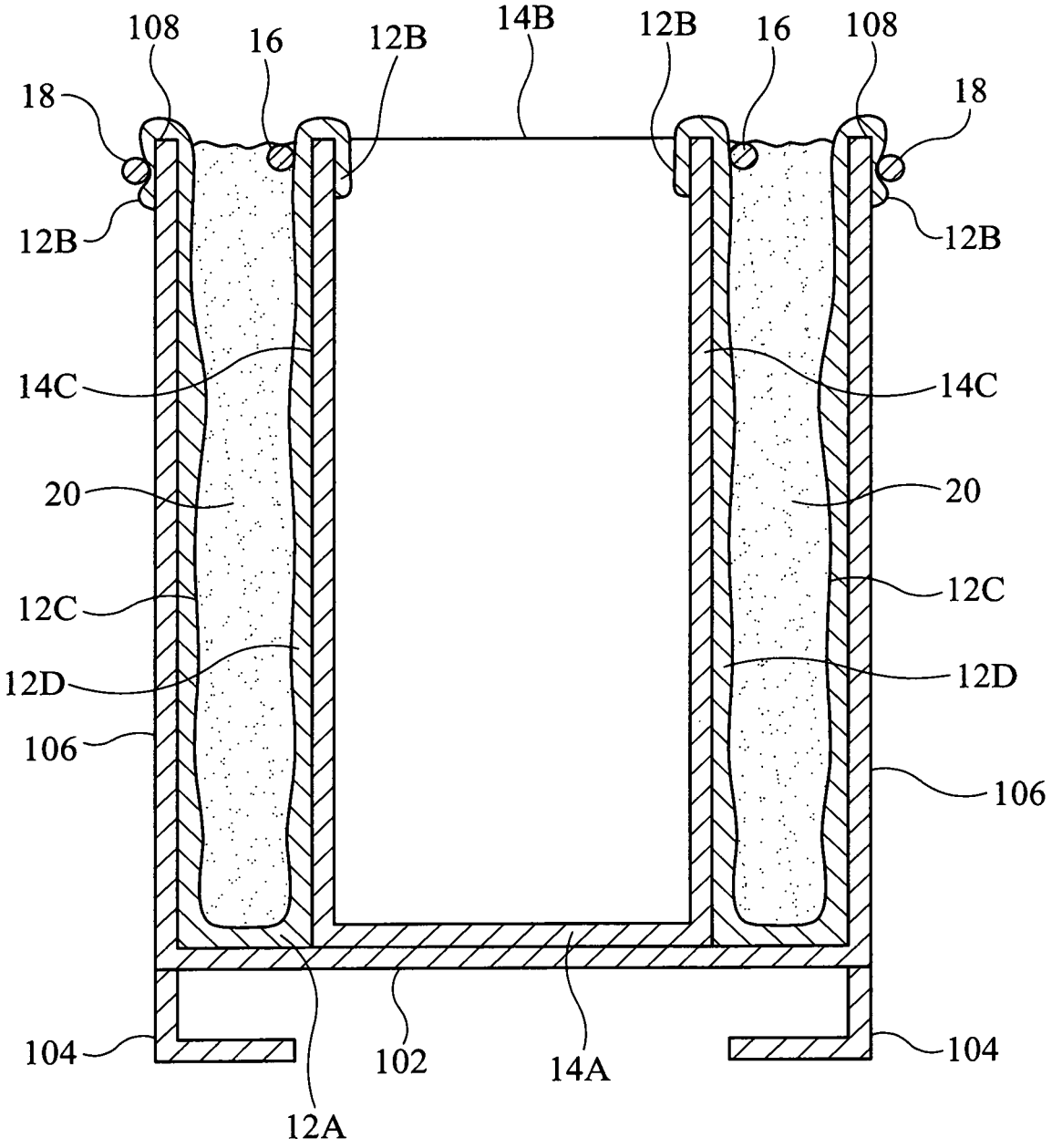
FIG. 4 is a cross-sectional view of an assembled and liquid-filled blast containment system for a trash can in accordance with an embodiment of the present invention.

Referring now to the drawings, simultaneous reference will be made to FIGS. 1 and 4 where a blast containment system for a trash can in accordance with an embodiment of the present invention is illustrated. In each figure, a conventional trash can 100 serves as the support structure for the blast containment system. In general, trash can 100 is made from a rigid material (e.g., metal, hard plastic, etc.) that has little to no blast containment attributes. As is well-known in the art, trash can 100 generally has a base 102 that can include legs/feet 104, and side walls 106 leading from base 102 up to an open top 108. A lid (not shown) may be provided for engagement with open top 108 where such a lid will generally be removable and/or have an opening through which trash can be deposited. A variety of trash can designs could be used to support a blast containment system of the present invention without departing from the scope of the present invention.

A blast containment system in accordance with an embodiment of the present invention includes a number of solid elements (referenced generally by numeral 10 in FIG. 1) and a liquid 20 (shown only in FIG. 4) disposed between some of solid elements 10. Solid elements 10 include a flexible donut-shaped bag 12, a rigid open-top container 14, and retainers 16 and 18. Details and attributes of solid elements 10 and liquid 20 will be described further below.

Figure 2:
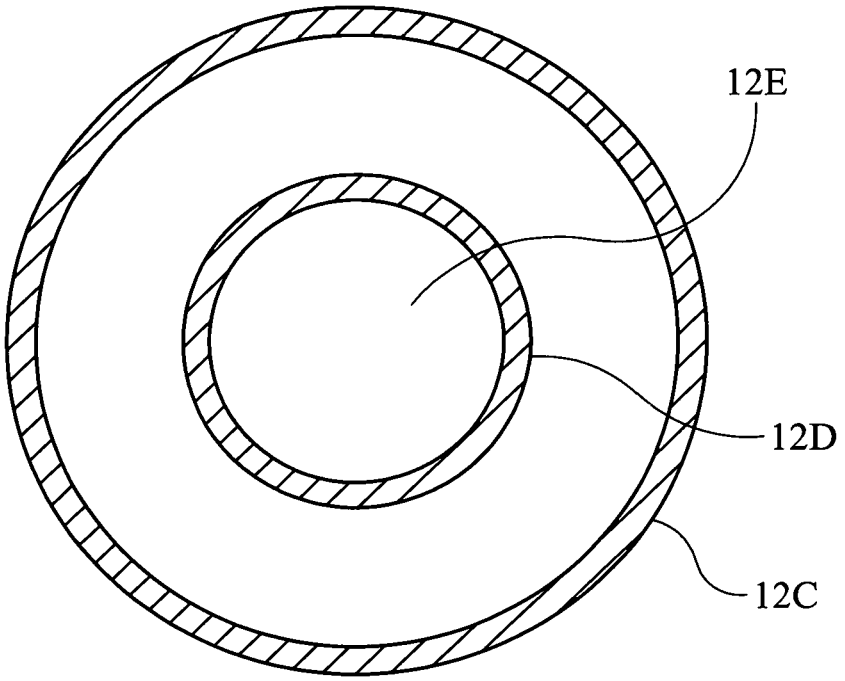
FIG. 2 is a cross-sectional view of the blast containment system's donut-shaped bag taken along line 2-2 in FIG. 1.
Figure 3:
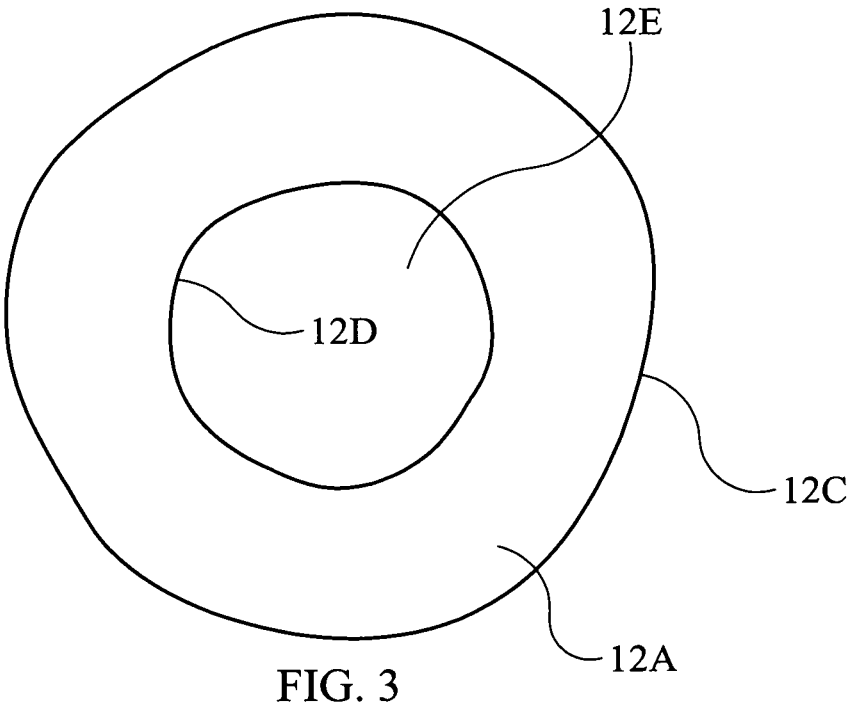
FIG. 3 is a bottom view of the blast containment system's donut-shaped bag taken along line 3-3 in FIG. 1.

Additional reference will now be made to FIGS. 2 and 3 where isolated cross-sectional and bottom views, respectively, of donut-shaped bag 12 are illustrated. In general, donut-shaped bag 12 is made from a material that is impervious to liquid. Donut-shaped bag 12 is sealed at a donut-shaped end 12A (i.e., the bottom of bag 12 illustrated in FIG. 3) and is unsealed or open at its opposing donut-shaped end 12B (i.e., the top of bag 12) with ends 12A and 12B being connected by exterior side walls 12C and interior side walls 12D such that an open-ended tubular region 12E extends through bag 12. In use, container 14 is disposed in tubular region 12E as will be explained further below.

Bag 12 is sized such that sealed end 12A may rest on base 102 of trash can 100 while unsealed/open end 12B extends up to and beyond open top 108 of trash can 100 and the open top 14B of container 14. Accordingly, end 12B may be retained at open top 108 and open top 14B as will be explained further below. In addition to being impervious to liquid, bag 12 may be made from materials that have some blast and/or blast fragment containment properties. For example, bag 12 could be made from a natural or synthetic rubber with the entirety thereof or just its side walls 12C/12D including one or more materials having ballistic-arresting properties (e.g., at least one of Kevlar, Lexan, graphene, carbon fibers, fiber-reinforcement, steel-reinforcement, metal wire-reinforcement, etc.).

Figure 6:
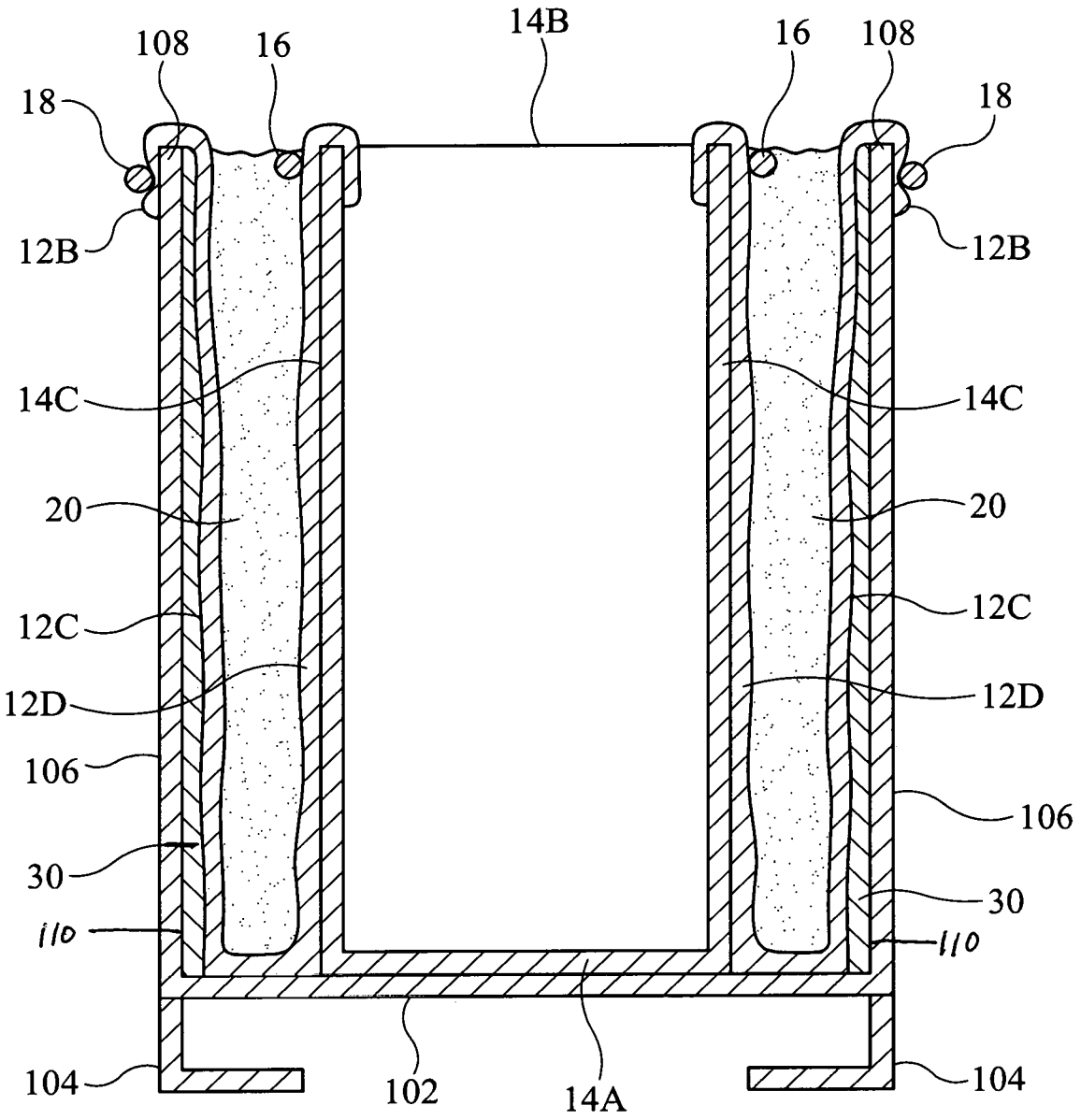
FIG. 6 is a cross-sectional view of an assembled and liquid-filled blast containment system for a trash can in accordance with still another embodiment of the present invention.

Rigid open-top container 14 serves as a refuse container and the first line of a blast containment defense provided by the blast containment system of the present invention. Rigid container 14 includes a closed bottom 14A, and side walls 14C extending up to an open top 14B. Container 14 is sized such that open top 14B is approximately aligned with open top 108 of trash can 100 when container 14 rests therein. At least side walls 14C of container 14 are made from one or more ballistic materials such as at least one of ceramics, steel, titanium, rubber, Kevlar, Lexan, graphene, carbon fibers, fiber-reinforcement, steel-reinforcement, and metal wire-reinforcement. In general, container 14 is sized such that an annular volume is defined between its side walls 14C and side walls 106 of trash can 100 to hold bag 12 filled with liquid 20. The side walls 106 of the trash can also include an interior side wall surface 110 as illustrated in FIG. 6.

Figure 5:
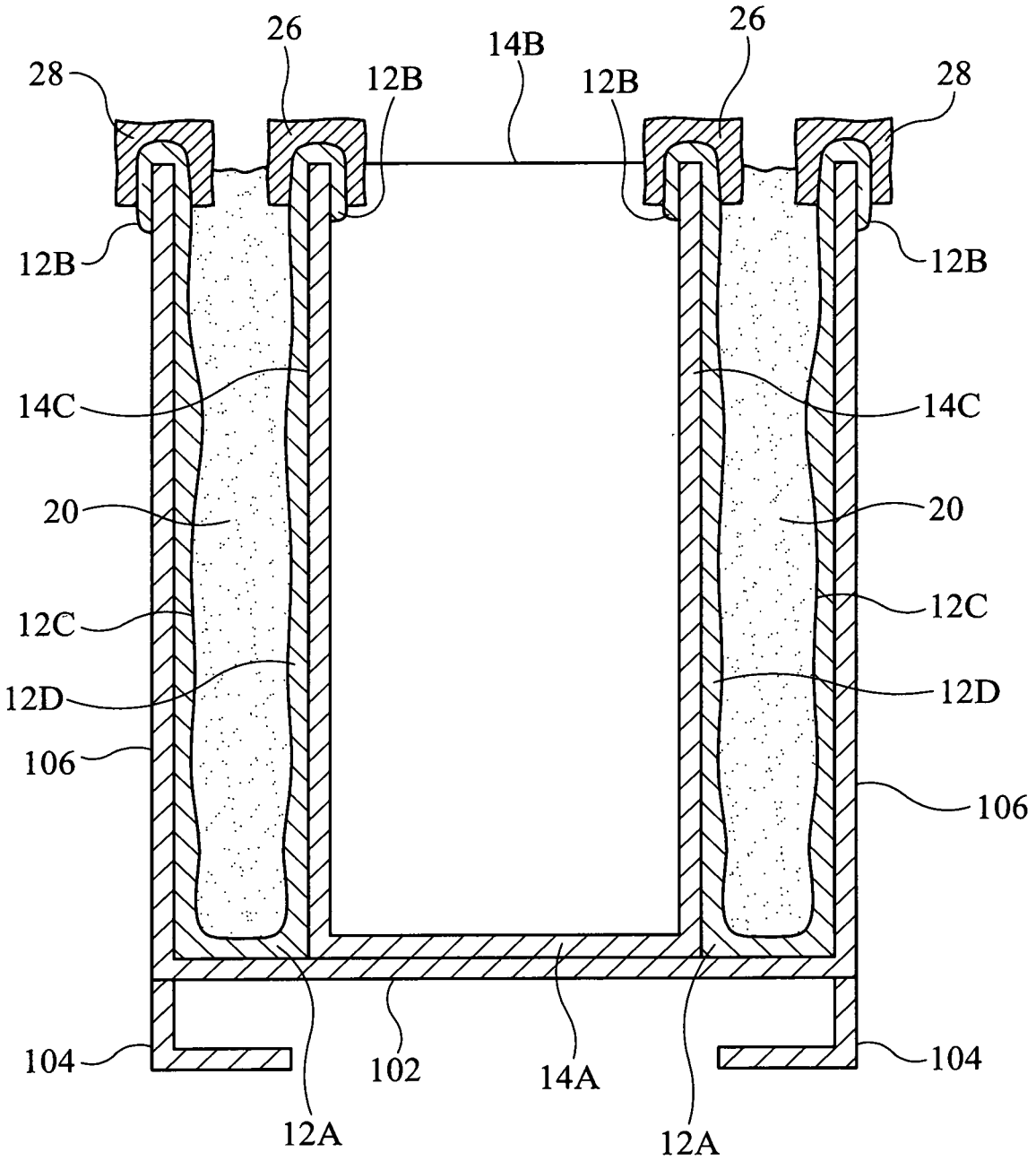
FIG. 5 is a cross-sectional view of an assembled and liquid-filled blast containment system for a trash can in accordance with another embodiment of the present invention.

Retainers 16 and 18 may be a simple hoop (i.e., large O-rings) of an elastic material used to hold unsealed/open end 12B of bag 12 at the periphery of open top 108 of trash can 100 and at the open top 14B of container 14. For example and as illustrated, the interior side walls 12D of the bag 12 can be retained at open top 14B by elastic retainer 16, while the exterior side walls 12C of the bag 12 may be retained at open top 108 by elastic retainer 18. Retainers 16 and 18 can be separate elements (as shown), but could also be integrated into bag 12 in ways well-known in the art and without departing from the scope of the present invention. Retainers 16 and 18 could also be realized by annular clips 26 and 28 as shown in FIG. 5 to keep bag 12 in place. Accordingly, it is to be understood that retention of bag 12 at open top 108 and open top 14B can be achieved in a variety of ways without departing from the scope of the present invention.

In use, container 14 is placed in trash can 100 and bag 12 is placed in the annular space between container 14 and trash can 100 such that container 14 is disposed in tubular region 12E of bag 12. Bag 12 is retained place by, for example, retainers 16 and 18 as described above. Bag 12 is then filled with liquid 20. For good blast containment, the radial thickness "T" of liquid 12 may be in a range of 6 to 12 inches. The substantially constant radial thickness of liquid 12 assures that blast fragments (generated in container 14 during a bomb blast therein) are softly caught within the containment system. As a result, blast fragments are generally prevented from propagating horizontally where potential victims would be located.

Liquid 20 provides the second level or stage of ballast containment. Liquid 20 may be fresh or tap water, and can include one or more solutes to provide additional attributes. For example, liquid 20 could be a mixture of water and an antifreeze additive (e.g., salt) for use in cold environments. Additionally or alternatively, liquid 20 could be a mixture of water and a solute offering blast containment attributes such as cornstarch.

The advantages of the present invention are numerous. The blast containment system is relatively inexpensive and readily adaptable for use with a variety of trash can designs. The system is readily transported to a site/venue and can be installed in a matter of minutes.

Although the invention has been described relative to a specific exemplary embodiment thereof, there are numerous variations and modifications that will be readily apparent to those skilled in the art in light of the above teachings. For example and in an exemplary embodiment as shown in FIG. 6, a ballistic fabric 30 may be disposed inside of trash can 100 and around an outside 12C (also referenced as the exterior side walls 12C) of bag 12 so as to be, in an exemplary embodiment, situated intermediate the exterior side walls 12C and the interior side wall surface 110 of the trash can 100. The ballistic fabric may be comprised of at least one of ceramics, steel, titanium, rubber, Kevlar, Lexan, graphene, and carbon fibers. A drain port could be provided in flexible bag 12 to allow liquid 20 to be readily drained therefrom. In addition, a flat ring could be attached to or integrated with open top 108 such that the flat ring would extend over the top of liquid 20 to keep refuse from inadvertently being deposited therein. Such a ring could also define a sloped surface towards open top 108 to direct any deposited towards open top 108. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A blast containment system for a trash can, comprising:

a flexible donut-shaped bag being adapted for positioning in the trash can, said bag includes a sealed donut-shaped bottom adapted to be positioned at a base of the trash can, said bag includes an open donut-shaped top adapted to be positioned and retained at a top periphery of the trash can wherein an open-ended tubular region extends through said bag between said donut-shaped top and said donut-shaped bottom, and said bag is impervious to liquid;

a rigid container having an open top disposed in said tubular region of said bag, said open top coupled to said donut-shaped top of said bag, said open top adapted to be approximately aligned with the top periphery of the trash can, said rigid container includes side walls comprised of ballistic materials;

a liquid filling said flexible donut-shaped bag; and a ballistic fabric being situated inside of the trash can and outside of the flexible donut-shaped bag.

2. The blast containment system as in claim 1, further comprising retainers for attaching said donut-shaped top of said bag to said rigid container and being adapted for attaching s donut-shaped top of said bag to the top periphery of the trash can.

3. The blast containment system as in claim 1, wherein said bag comprises a rubber material.

4. The blast containment system as in claim 1, wherein said bag includes interior sidewalls and exterior sidewalls, wherein the side walls of the bag are comprised of at least one of rubber, Kevlar, Lexan, graphene, and carbon fibers.

5. The blast containment system as in claim 1, wherein said liquid includes water.

6. The blast containment system as in claim 5, wherein said liquid includes at least one solute selected from the group consisting of an antifreeze additive and cornstarch.

7. The blast containment system as in claim 1, wherein said ballistic materials of the rigid container are selected from at least one of ceramics, steel, titanium, rubber, Kevlar, Lexan, graphene, and carbon fibers.

8. A blast containment system for trash cans, comprising:

a flexible donut-shaped bag being adapted for positioning in a rigid trash can, said bag includes a sealed donut-shaped bottom adapted to be positioned at a base of the trash can, said bag includes an open donut-shaped top adapted to be positioned at a top periphery of the trash can wherein an open-ended tubular region extends through said bag between said donut-shaped top and said donut-shaped bottom, and said bag is impervious to liquid;

a rigid container having an open top being disposed in said tubular region of said bag, said open top coupled to said donut-shaped top of said bag, said open top adapted to be approximately aligned with the top periphery of the trash can, and said rigid container has side walls, wherein the side walls include ballistic materials;

retainers for attaching said donut-shaped top of said bag to said rigid container and being adapted to attach said donut-shaped top of said bag to the top periphery of the trash can;

a liquid to include water filling said bag; and a ballistic fabric being situated intermediate inside of the rigid trash can, and outside and around the flexible donut-shaped bag.

9. The blast containment system as in claim 8, wherein said bag comprises a rubber material.

10. The blast containment system as in claim 1, wherein said bag includes interior sidewalls and exterior sidewalls, wherein the side walls of the bag are comprised of at least one of rubber, Kevlar, Lexan, graphene, and carbon fibers.

11. The blast containment system as in claim 8, wherein said liquid further includes at least one solute selected from the group consisting of an antifreeze additive and cornstarch.

12. The blast containment system as in claim 8, wherein said ballistic materials of the rigid container are comprised of at least one of ceramics, steel, titanium, rubber, Kevlar, Lexan, graphene, and carbon fibers.

13. A blast containment system for a trash can comprising an interior side wall surface, comprising:

a flexible donut-shaped bag being adapted for positioning in the trash can, said bag includes a sealed donut-shaped bottom adapted to be positioned at a base of the trash can, said bag includes an open donut-shaped top adapted to be positioned and retained at a top periphery of the trash can wherein an open-ended tubular region extends through said bag between said donut-shaped top and said donut-shaped bottom, said bag is impervious to liquid, wherein said bag includes interior side walls and exterior side walls;

a rigid container having an open top disposed in said tubular region of said bag, said open top coupled to said donut-shaped top of said bag, said open top adapted to be approximately aligned with the top periphery of the trash can, said rigid container has side walls which include ballistic materials selected from the group consisting of ceramics, steel, titanium, rubber, Kevlar, Lexan, graphene, and carbon fibers;

a liquid filling said bag; and a ballistic fabric being situated intermediate the exterior side walls of the bag and the interior side wall surface of the trash can.

14. The blast containment system as in claim 13, further comprising retainers for attaching said donut-shaped top of said bag for said rigid container and being adapted to attach said donut-shaped top of said bag to the top periphery of the trash can.

15. The blast containment system as in claim 13, wherein said liquid includes water.

16. The blast containment system as in claim 15, wherein said liquid includes at least one solute selected from the group consisting of an antifreeze additive and cornstarch.

17. The blast containment system for a trash can as in claim 13, wherein the trash can is a rigid-trash can.

* * * * *